US010701468B1

(12) United States Patent
Yuan

(10) Patent No.: US 10,701,468 B1
(45) Date of Patent: Jun. 30, 2020

(54) MOUNTING ASSEMBLY AND ELECTRONIC DEVICE HAVING THE SAME

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventor: Bo-Duo Yuan, Shenzhen (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/535,219

(22) Filed: Aug. 8, 2019

(30) Foreign Application Priority Data

May 8, 2019 (CN) ..... 2019 2 0657269 U

(51) Int. Cl.
*H04R 1/02* (2006.01)
*H04R 1/04* (2006.01)

(52) U.S. Cl.
CPC ..... *H04R 1/025* (2013.01); *H04R 1/04* (2013.01); *H04R 2499/11* (2013.01)

(58) Field of Classification Search
CPC ... H04R 1/02; H04R 1/28; H04R 1/08; H04R 1/075; H04R 1/00; H04R 1/023; H04R 1/025; H04M 1/035
USPC ..... 386/334, 386, 388; 381/334, 386, 388, 381/392, 368, 353
See application file for complete search history.

(56) References Cited

U.S. PATENT DOCUMENTS 7,953,461 B2 * 5/2011 Fukazawa ..... H04M 1/03 455/569.1
8,548,189 B2 * 10/2013 Xiao ..... H04R 1/025 381/322
2019/0014406 A1 * 1/2019 Qin ..... H04R 1/2803

* cited by examiner

*Primary Examiner* — Melur Ramakrishnaiah
(74) *Attorney, Agent, or Firm* — ScienBiziP, P.C.

(57) ABSTRACT

A miniaturized mounting assembly for the acoustic elements in an electronic device includes a housing and a functional box having function elements therein. The functional box is fastened in the housing. A chamber is defined on the housing. An elastic member is fixed on an inner end of the chamber. One end of the functional box abuts against the elastic member, and the other end of the functional box abuts against another end of the chamber away from the elastic member, thereby integrally fixing the functional box in the chamber. An electronic device having the mounting assembly is also provided.

14 Claims, 5 Drawing Sheets

MOUNTING ASSEMBLY AND ELECTRONIC DEVICE HAVING THE SAME

FIELD

The subject matter herein generally relates to miniature electro-acoustic devices, in particular to a mounting assembly and an electronic device having the same.

BACKGROUND

Portable electronic devices are becoming smaller and smaller, and the requirements for sound quality of such devices are also increasing. The speaker module is an important acoustic component of a portable electronic device, being an energy conversion device for converting electrical signals into sound waves. Electro-acoustic effects are required in the devices. To ensure excellent acoustic performance, separate speaker boxes are used. For good sealing between the sound hole to the exterior and the speaker box, the speaker box assembly needs to be fixed with a precise positioning pressing fixture and multiple screws. Such a manufacturing method is cumbersome in assembly and has a low yield.

Therefore, there is room for improvement within the art.

BRIEF DESCRIPTION OF THE DRAWINGS

Implementations of the present technology will now be described, by way of embodiments, with reference to the attached figures.

DETAILED DESCRIPTION

Figure 1:
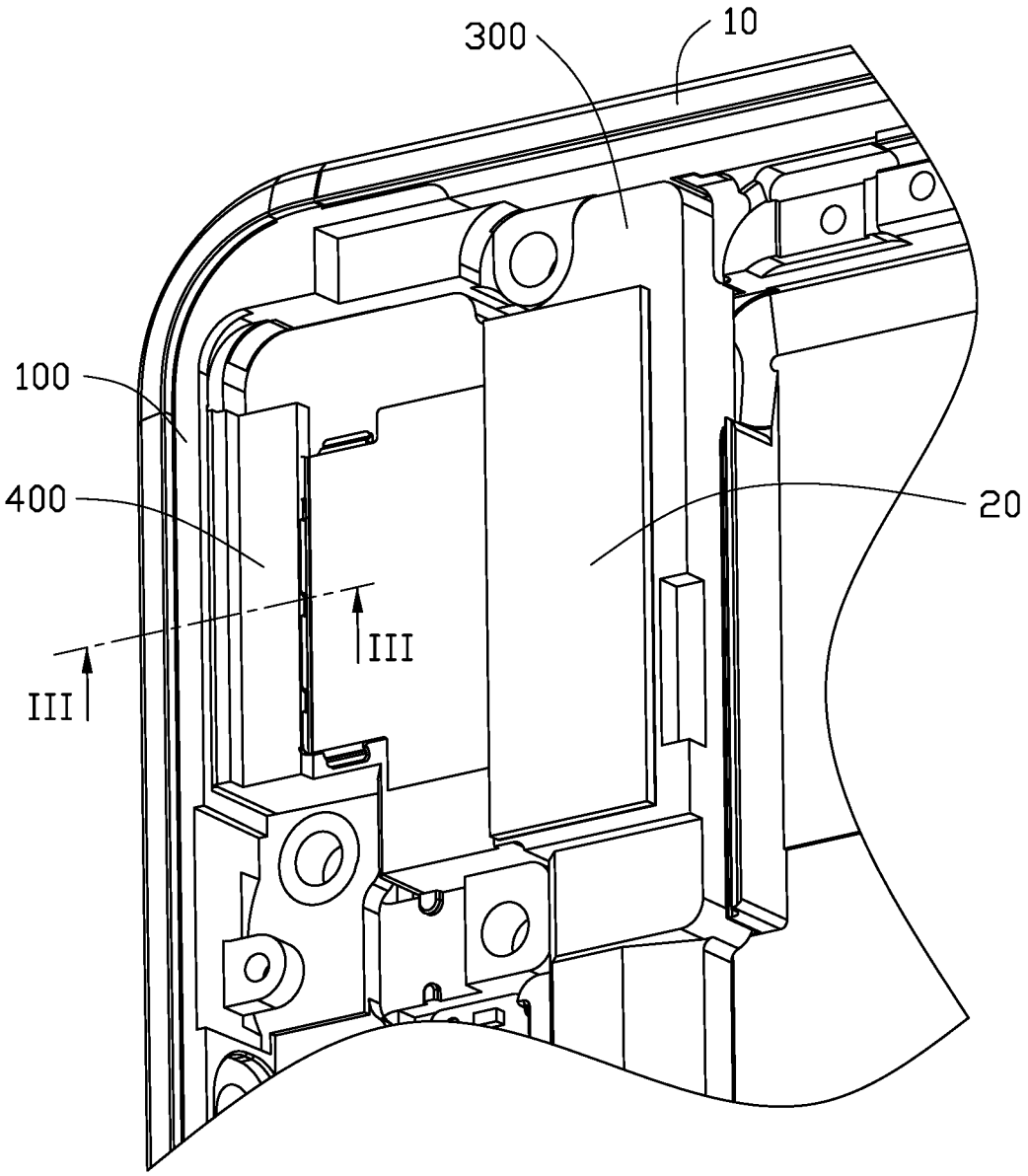
FIG. 1 is an isometric view of part of a mounting assembly assembled in an electronic device according to an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

FIG. 1 shows part of an electronic device 10. The electronic device 10 may be, but is not limited to, a cell phone, a tablet, a smart bracelet, or a file reader. The electronic device 10 has a mounting assembly 20 therein.

Figure 2:
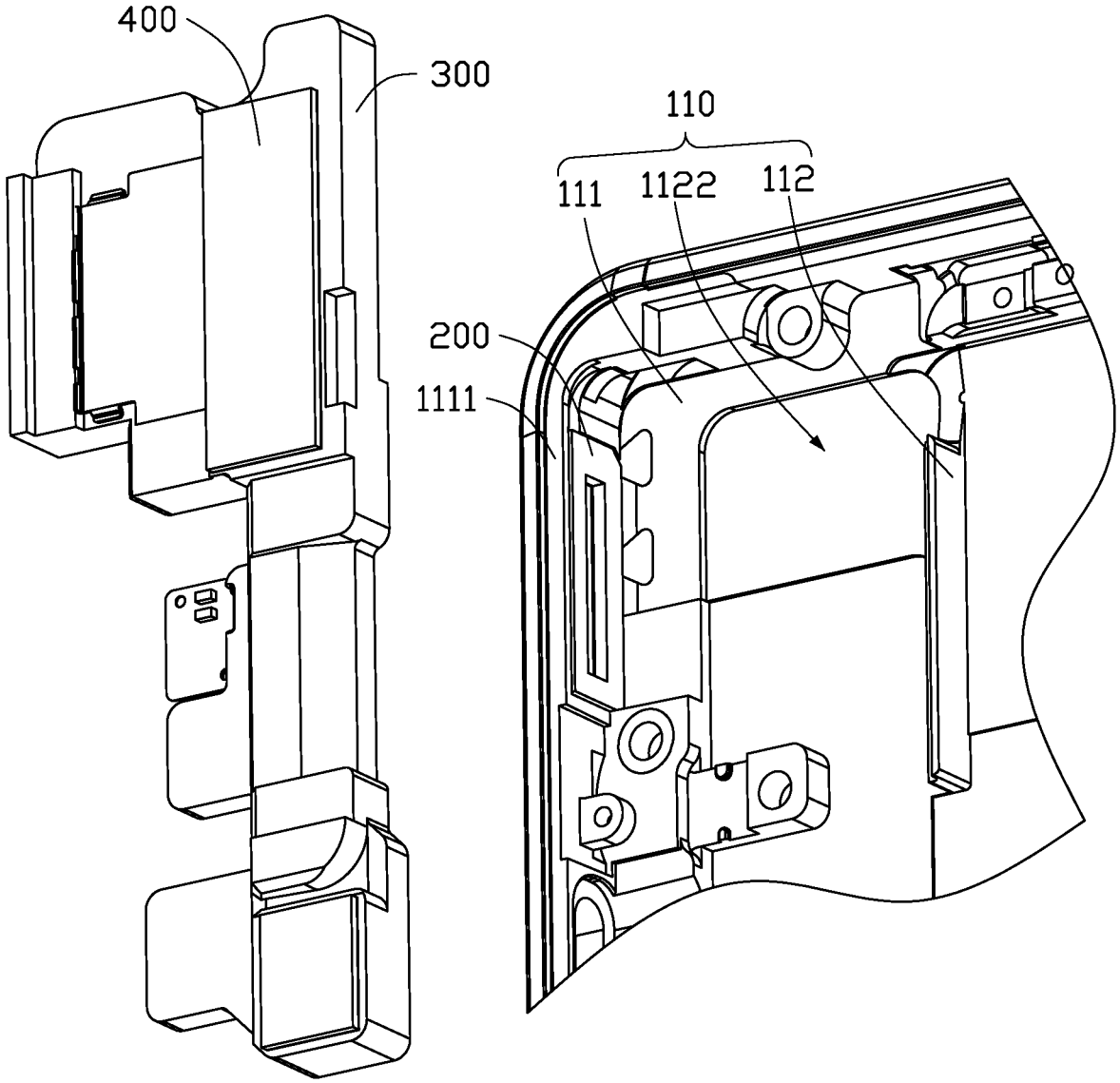
FIG. 2 is an isometric, exposed view of the mounting assembly of FIG. 1.

Referring to FIG. 1 and FIG. 2, the mounting assembly 20 includes a housing 100 and a functional box 300. The housing 100 may be a housing of the electronic device 10. The functional box 300 is provided with function elements 400 therein. The function elements 400 may be, but are not limited to, speakers and/or microphones.

Figure 3:
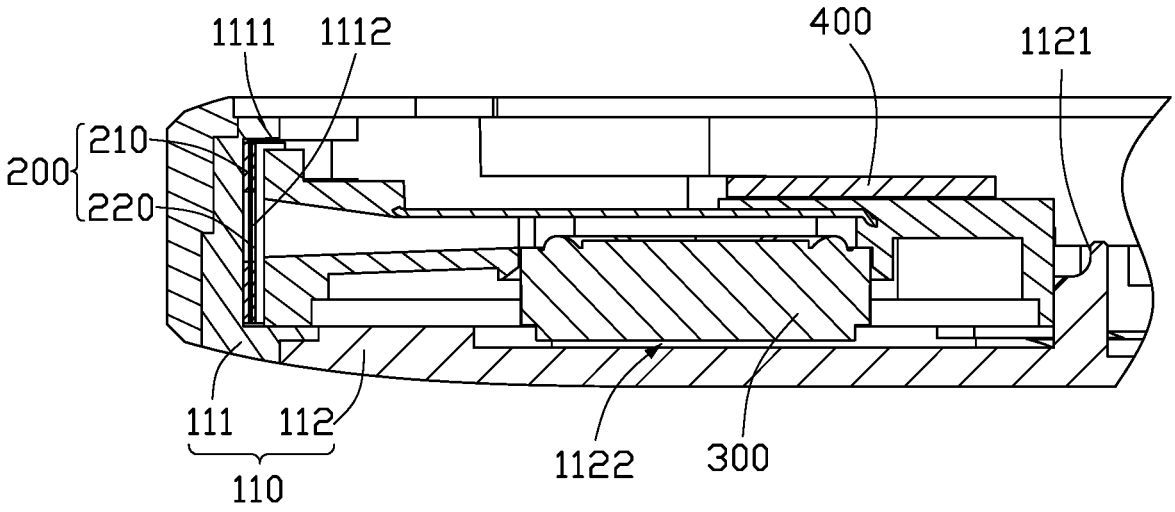
FIG. 3 is a section view along a view line III-III of FIG. 1.

Referring to FIG. 2 and FIG. 3, a chamber 110 is defined on the housing 100 for placing and fixing the functional box 300. Specifically, the chamber 110 is formed from a first cavity portion 111 and a second cavity portion 112. The first cavity portion 111 and the second cavity portion 112 are coupled to form the chamber 110.

Specifically, the first cavity portion 111 is made of metal material. The preferred metal material is aluminum. A portion of the housing 100 is made of aluminum to be the first cavity portion 111. The first cavity portion 111 is located at the edge of the electronic device 10 for improving the drop resistance of the electronic device 10. The second cavity portion 112 is made of plastic material. The preferred plastic material is rigid plastic. The second cavity portion 112, in another portion of the housing 100, is also made of the rigid plastic. The second cavity portion 112 is located at the middle of the electronic device 10 for improving the stability of the electronic device 10 and reducing the weight of the electronic device 10, also reducing the cost of the electronic device 10. Further, the rigid plastic may be, but is not limited to, polycarbonate (PC) or acrylonitrile-butadiene-styrene copolymer (ABS).

Furthermore, an elastic member 200 is fixed to an inner side of the first cavity portion 111. A protrusion 1111 protrudes from a top portion of the first cavity portion 111 towards the second cavity portion 112. The protrusion 1111 and a bottom portion of the first cavity portion 111 together form a fixing cavity 1112 in which the elastic member 200 is fixed.

Specifically, as shown in FIG. 3, the elastic member 200 includes a connecting sheet 210 and an elastic sheet 220. The connecting sheet 210 and the elastic sheet 220 are fixedly connected. The connecting sheet 210 connects the inner side of the first cavity portion 111 and the elastic sheet 220. The elastic sheet 220 abuts against the functional box 300. The middle portion of the elastic member 200 is hollowed, to enhance elasticity, and for saving material usage of the elastic member 200, the cost of the mounting assembly 20 can be further reduced. In an embodiment, the elastic sheet 220 is an elastic foam having a high repulsive force.

Furthermore, the top of the outer edge of the second cavity portion 112 away from the elastic member 200 is an arcuate body 1121. The arcuate body 1121 protrudes from the top of the outer edge of the second cavity portion 112 towards the first cavity portion 111 to the middle portion of the outer edge of the second cavity portion 112.

An escaping cavity 1122 is defined on the bottom of the second cavity portion 112. The escaping cavity 1122 faces out from the inside of the chamber 110. Correspondingly, the bottom of the functional box 300 is also provided with an escaping hole (not shown), and the one or more function elements 400 in the functional box 300 pass through the escaping hole to match with the escaping cavity 1122, such that the positions of the function elements 400 can be defined.

One end of the functional box 300 abuts against the elastic member 200 and is fixed in the first cavity portion 111. The other end of the functional box 300 abuts against the end of the chamber 110 away from the elastic member 200 and is fixed in the second cavity portion 112. Thus the functional box 300 is integrally fixed in the chamber 110. The sealing and fixing of the functional components can be achieved by using the elastic member 200 with high repulsive force. The specific process in which the functional box 300 is mounted in the chamber 110 is hereafter described.

Figure 4:
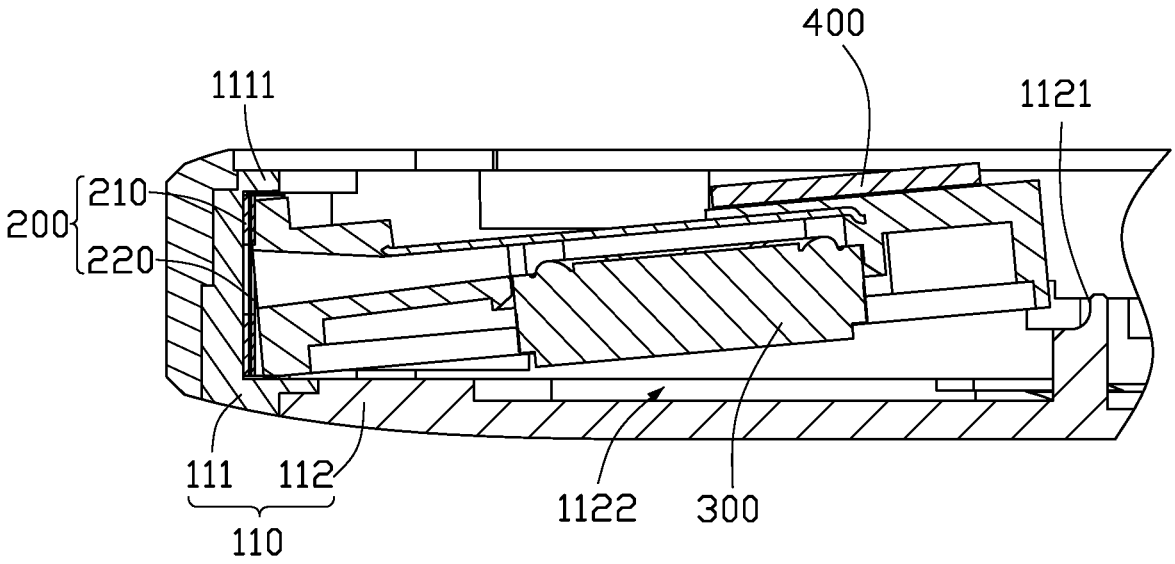
FIG. 4 shows the mounting assembly of FIG. 3 in a first state.
Figure 5:
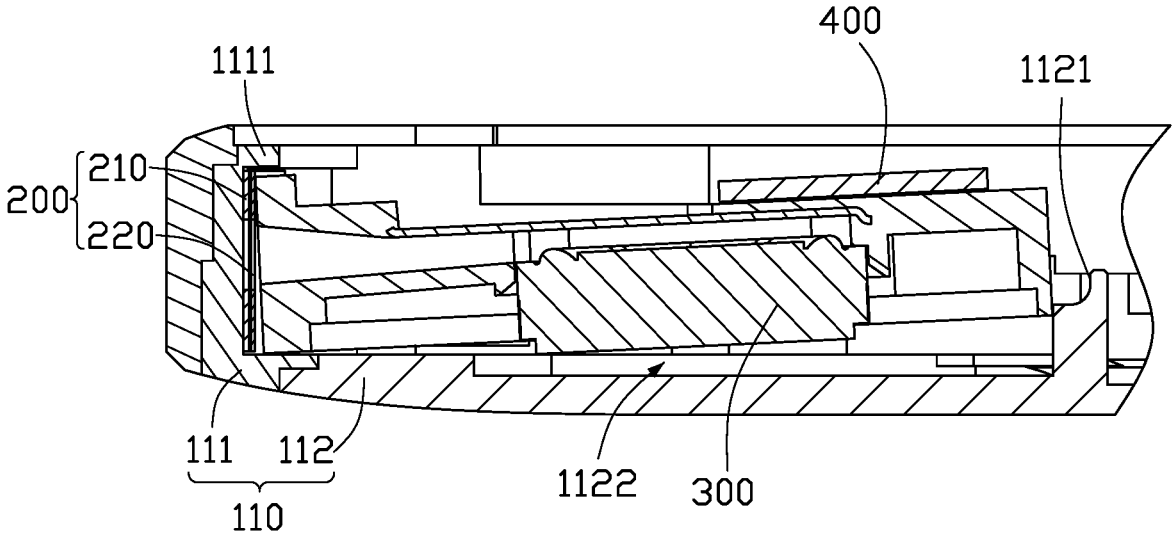
FIG. 5 shows the mounting assembly of FIG. 3 in a second state.

FIG. 4 shows a first state of the functional box 300 during the installation process. FIG. 5 shows a second state of the functional box 300 during the installation process. FIG. 3 shows a third state of the functional box 300 during the installation process.

When the functional box 300 is to be installed, the functional box 300 is tilted into the chamber 110 such that one end of the functional box 300 is in contact with the arcuate body 1121 of the second cavity portion 112, as shown in FIG. 4.

The functional box 300 is pushed towards the first cavity portion 111 and simultaneously pressed to the bottom of the chamber 110. The functional box 300 slides along the arcuate body 1121 of the second cavity portion 112 into the chamber 110, and the elastic member 200 is forced towards the inner side of the first cavity portion 111 under the action of the the functional box 300 to give way to the function members 400, as shown in FIG. 5.

When the functional box 300 is fully in place in the chamber 110, the elastic member 200 abuts against the functional box 300 under restoring force. One end of the functional box 300 abuts against the elastic member 200, and the other end of the functional box 300 is in close contact with the inner side of the second cavity portion 112. The elastic member 200 with high repulsive force ensures the firm sealing and stable fixing in place of the functional box 300, as shown in FIG. 3.

The functional box 300 of the mounting assembly 20 is fixed in place without screws. The mounting assembly 20 utilizes the strong rebound urge of the elastic member 200 to seal and fix the functional box 300 in the housing 100, greatly simplifying the assembly process, reducing assembly and reworking costs, and improving productivity.

The mounting assembly 20 of the electronic device 10 also carries and protects the function elements 400. The screwless fixing structure of the mounting assembly 20 saves complicated positioning, production line fixtures to press screws, and nuts, etc. in assembly, and reduces the cost of the electronic device 10.

When one of the function elements 400 in the functional box 300 of the mounting assembly 20 is a speaker, the screwless functional box 300 does not need a screw hole, the box 300 has a simple structure and saves space for the sound chamber, and sound quality of the electronic device 10 may be enhanced.

The embodiments shown and described above are only examples. Many such details are found in the relevant art. Therefore, such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A mounting assembly, comprising:

a housing; and a functional box comprising function elements therein, the functional box fastened in the housing, wherein a chamber is defined on the housing, an elastic member is fixed in the chamber and connected with one side of the chamber; one end of the functional box abuts against the elastic member, and the other end of the functional box abuts against another side of the chamber away from the elastic member, thereby integrally fixing the functional box in the chamber;

wherein the chamber is formed from a first cavity portion and a second cavity portion; the first cavity portion and the second cavity portion are coupled to form the chamber; and the elastic member is fixed to the first cavity portion; and wherein the elastic member comprises a connecting sheet and an elastic sheet, the connecting sheet and the elastic sheet are fixedly connected; the connecting sheet connects an inner side of the first cavity portion and the elastic sheet, and the elastic sheet abuts against the functional box.

2. The mounting assembly of claim 1, wherein a protrusion protrudes from a top portion of the first cavity portion towards the second cavity portion, the protrusion and a bottom portion of the first cavity portion together form a fixing cavity in which the elastic member is fixed.

3. The mounting assembly of claim 1, wherein the elastic sheet is an elastic foam.

4. The mounting assembly of claim 1, wherein the first cavity portion is made of metal material, and the second cavity portion is made of plastic material.

5. The mounting assembly of claim 1, wherein a top of an outer edge of the second cavity portion away from the elastic member is an arcuate body, and the arcuate body protrudes from the top of the outer edge of the second cavity portion towards the first cavity portion to a middle portion of the outer edge of the second cavity portion.

6. The mounting assembly of claim 5, wherein an escaping cavity is defined on a bottom of the second cavity portion, a bottom of the functional box is provided with an escaping hole, and the function element in the functional box passes through the escaping hole to match with the escaping cavity.

7. The mounting assembly of claim 1, wherein the function element is a speaker or a microphone.

8. An electronic device comprising a mounting assembly, the mounting assembly comprising:

a housing; and a functional box comprising function elements therein, the functional box fastened in the housing, wherein a chamber is defined on the housing, an elastic member is fixed in the chamber and connected with one side of the chamber; one end of the functional box abuts against the elastic member, and the other end of the functional box abuts against another side of the chamber away from the elastic member, thereby integrally fixing the functional box in the chamber;

wherein the chamber is formed from a first cavity portion and a second cavity portion; the first cavity portion and the second cavity portion are coupled to form the chamber; and the elastic member is fixed to the first cavity portion; and wherein the elastic member comprises a connecting sheet and an elastic sheet, the connecting sheet and the elastic sheet are fixedly connected; the connecting sheet connects an inner side of the first cavity portion and the elastic sheet, and the elastic sheet abuts against the functional box.

9. The electronic device of claim 8, wherein a protrusion protrudes from a top portion of the first cavity portion towards the second cavity portion, the protrusion and a bottom portion of the first cavity portion together form a fixing cavity in which the elastic member is fixed.

10. The electronic device of claim 8, wherein the elastic sheet is an elastic foam.

11. The electronic device of claim 8, wherein the first cavity portion is made of metal material, and the second cavity portion is made of plastic material.

12. The electronic device of claim 8, wherein a top of an outer edge of the second cavity portion away from the elastic member is an arcuate body, and the arcuate body protrudes from the top of the outer edge of the second cavity portion towards the first cavity portion to a middle portion of the outer edge of the second cavity portion.

13. The electronic device of claim 12, wherein an escaping cavity is defined on a bottom of the second cavity portion, a bottom of the functional box is provided with an escaping hole, and the function element in the functional box passes through the escaping hole to match with the escaping cavity.

14. The electronic device of claim 8, wherein the function element is a speaker or a microphone.

* * * * *